US008635813B2

(12) United States Patent
Delaney

(10) Patent No.: US 8,635,813 B2
(45) Date of Patent: Jan. 28, 2014

(54) DEPLOYMENT MECHANISM FOR A RETRACTABLE ROOF SYSTEM FOR A LARGE BUILDING STRUCTURE

(76) Inventor: François Delaney, L'assomption (CA)

( * ) Notice: Subject to any disclaimer, the term of this patent is extended or adjusted under 35 U.S.C. 154(b) by 40 days.

(21) Appl. No.: 12/737,449

(22) PCT Filed: Jul. 14, 2009

(86) PCT No.: PCT/CA2009/000974

§ 371 (c)(1),
(2), (4) Date: Jan. 14, 2011

(87) PCT Pub. No.: WO2010/006425

PCT Pub. Date: Jan. 21, 2010

(65) Prior Publication Data

US 2011/0107686 A1 May 12, 2011

Related U.S. Application Data

(60) Provisional application No. 61/129,710, filed on Jul. 14, 2008.

(51) Int. Cl.

| | |
|---|---|
| ***E04H 3/10*** | (2006.01) |
| ***E04B 1/346*** | (2006.01) |
| ***E04B 7/16*** | (2006.01) |

(52) U.S. Cl.
USPC ..... 52/66; 52/6; 52/72

(58) Field of Classification Search
USPC ..... 52/6, 66, 72, 80.1
See application file for complete search history.

(56) References Cited

U.S. PATENT DOCUMENTS

| | | | | | |
|---|---|---|---|---|---|
| 3,510,996 | A | * | 5/1970 | Popil | 52/64 |
| 4,488,621 | A | * | 12/1984 | Schiewe | 187/347 |
| 4,587,775 | A | * | 5/1986 | Lewis et al. | 52/65 |
| 4,727,688 | A | * | 3/1988 | Kida et al. | 52/6 |
| 4,802,314 | A | * | 2/1989 | Schildge, Jr. | 52/6 |
| 4,831,792 | A | * | 5/1989 | Berger | 52/66 |
| 4,942,698 | A | * | 7/1990 | Kumagai | 52/6 |
| 4,995,203 | A | | 2/1991 | Brisbin et al. | |
| 5,007,214 | A | * | 4/1991 | Itami et al. | 52/66 |
| 5,394,659 | A | * | 3/1995 | Kawaguchi et al. | 52/66 |
| 5,848,499 | A | * | 12/1998 | Schildge, Jr. | 52/66 |
| 5,904,003 | A | * | 5/1999 | Stephen | 52/6 |
| 6,003,269 | A | * | 12/1999 | McRee | 52/6 |

(Continued)

FOREIGN PATENT DOCUMENTS

EP 1259678 B1 11/2002

OTHER PUBLICATIONS

URL:http://en.wikipedia.org/wiki/Category:Retractable-roof_stadiums>, accessed Sep. 29, 2009, 2 pages.

*Primary Examiner* — Ryan Kwiecinski
(74) *Attorney, Agent, or Firm* — Equinox IP; Franz Bonsang

(57) ABSTRACT

A retractable roof system (30) for a large building structure (32) for selectively closing off an opening (39) of a fixed roof (34) of the building structure (32), the system includes at least one roof section (40) movably mountable on at least one pier (42). A deployment mechanism (46) is provided and includes ropes (66) and pulleys (68) appropriately mounted on the top section (50) of the pier (42). The ropes (66) extend from an actuating piston (60) to the movable part (44) of the top section (50).

6 Claims, 22 Drawing Sheets

(56) References Cited

U.S. PATENT DOCUMENTS

| | | | | |
|---|---|---|---|---|
| 6,082,054 | A | 7/2000 | Silberman et al. | |
| 6,754,994 | B2 * | 6/2004 | Jahanpour | 52/66 |
| 2002/0129565 | A1 * | 9/2002 | Silberman et al. | 52/66 |
| 2003/0046879 | A1 * | 3/2003 | Jahanpour | 52/66 |
| 2011/0107687 | A1 * | 5/2011 | Delaney | 52/66 |
| 2011/0107688 | A1 * | 5/2011 | Delaney | 52/66 |

* cited by examiner

DEPLOYMENT MECHANISM FOR A RETRACTABLE ROOF SYSTEM FOR A LARGE BUILDING STRUCTURE

CROSS REFERENCE TO RELATED APPLICATION

Benefit of priority of U.S. Provisional Application for Patent Ser. No. 61/129,710 filed on Jul. 14, 2008, is hereby claimed.

FIELD OF THE INVENTION

The present invention relates to roof support systems for large building structures and is more particularly concerned with a deployment mechanism for a retractable roof system for large building structures such as stadiums and the like and the components thereof.

BACKGROUND OF THE INVENTION

It is well known in the art to build stadiums for major sports events or the like that can receive many thousands of seated spectators. Most of these main sports events or other require an open sky over the sports field, while the grandstands are preferably protected by an over-hanging peripheral roof to protect the spectators from precipitation, e.g. rain, snow, etc. However, in regions with cold temperatures and frequent snowfalls during winter, or even with heavy rains, it would be beneficial to provide a complete covering for the stadium, namely a roof, but such a provision would preclude the holding of certain events thus limiting the scope of use.

This dilemma has been addressed by the installation of, retractable roof systems at various stadiums. However, these systems are generally very expensive, complex, raise safety issues, and may require time-consuming deployment mechanisms, which may militate against their installation.

Accordingly, there is a need for an improved deployment mechanism for a retractable roof system for large building structures and improved components used therefor.

SUMMARY OF THE INVENTION

It is therefore a general object of the present invention to provide an improved deployment mechanism for a retractable roof system for large building structures and/or improved components used therefore, which solves the above mentioned problems.

An advantage of the deployment mechanism of the present invention is that it is relatively simple (pneumatic) and allows, by default, the retractable roof to remain in the closed configuration. The weight (piston) has to be raised into its cylinder in order to open the roof.

According to a first aspect of the invention a retractable roof system for a large building structure for selectively closing off a roof opening of the building structure, said roof system being characterized by:

- a generally planar roof structure for substantially covering the opening;
- a deployment mechanism connected to the retractable roof system and allowing translational displacement of said roof system between a deployed position in which said roof system closes off the opening, and a retracted position in which the opening is generally uncovered and said roof system is retracted to a parked position.

The deployment mechanism is conveniently adapted to effect translational displacement in a substantially horizontal or in a substantially vertical direction.

The roof system is drawn across the said opening in a substantially horizontal direction.

The roof system is elevated in a substantially vertical direction into a closure position in relation to said opening.

In an alternative embodiment, the translational displacement may be effected in an angular orientation between horizontal and vertical.

According to another aspect of the present invention, there is provided a retractable roof system for a large building structure for selectively closing off an opening of a fixed roof of the building structure, said retractable roof system comprising:

- a generally planar roof structure for substantially covering the opening and having at least one roof section;
- at least one self-supporting structural pier for supporting a corresponding roof section; and
- a deployment mechanism connecting each said roof section to a corresponding said pier, said deployment mechanism allowing translational displacement of each said roof section between a deployed position in which said roof section closes off a portion of the opening, and a retracted position in which the opening is generally uncovered and said roof section is generally located in vertical alignment with at least a portion of the fixed roof.

Conveniently, the roof structure has at least two complementary roof sections each roof section being supported by a respective pier.

Each roof section may be arranged to slide over or under the fixed roof when being deployed, the extent of the roof section and of the fixed roof being substantially coincident when the roof section is in the retracted position.

According to a still further aspect of the present invention there is provided a retractable roof system for a large building structure for selectively closing off an opening of a fixed roof of the building structure, said retractable roof system comprising:

- a generally planar roof structure for substantially covering the opening; and having at least one roof section;
- at least one self-supporting structural pier for supporting a corresponding roof section;
- a deployment mechanism connecting each said roof section to a roof connecting part of a substantially horizontal top section of the corresponding said pier, said deployment mechanism allowing translational displacement of each said roof section between a deployed position in which said roof section closes off a portion of the opening, and a retracted position in which the opening is generally uncovered and said roof section is generally located in vertical alignment with at least a portion of the fixed roof;
- the deployment mechanism comprising in combination a system of ropes and pulleys and an actuating element adapted to effect anchoring of the or each roof section in its respective position, the actuating element being fluid operable and comprising at least one cylinder in which there is slidably disposed a weight in the form of a piston on which a fluid is operable;
- wherein the piston is of such dimension as to require a relatively low-pressure fluid to effect requisite movement for the roof section to move, the application of fluid pressure or its removal occasioning the necessary movement.

The deployment mechanism may advantageously be operated by compressed air.

The ropes may be produced from any suitably strong material and are attached to and extend from the piston over the pulleys to be secured to the roof connecting part of the top section of the pier.

A deployment mechanism according to the invention may be employed for a number of roof sections or one such deployment mechanism may be employed for each roof section.

Conveniently the roof connecting part of the substantially horizontal top section is provided with a leading portion of stepped form for supporting a margin of the respective roof section. Said roof connecting part of the top section of the pier is in the form of a bracket reciprocally movable in relation to the top section of its respective pier.

The or each pier may be similar or identical in shape and dimension as the supporting structure(s) of the large building. For example, the piers may be of like form as the supporting structures, e.g. columns, of the building and in some embodiments may be disposed in close adjacency thereto. Such embodiments are appropriate for retrofit applications to existing buildings. In an alternative embodiment the piers and the supporting structures may be one and the same whereby the deployment mechanism is mounted on the supporting structure of the building and this design would be beneficial for a new building.

The fixed roof surmounts the pier with the roof section of the roof system being arranged to slide over or under the fixed roof.

The movable part of the leading portion of the top substantially horizontal section of the pier is in the form of a bracket carrying rollers slidable within a guide channel formed on the top section at either side thereof. The ropes of the deployment system being connected to the roof connecting part of the top section.

At the junction of the two roof sections of the retractable roof structure there is provided a system of panels which serve to bridge the junction thereby to close off the area beneath the whole of the roof. The system of panels is operated by a winch arrangement including a rope array reeved over wheels provided for this purpose, the panels being provided with rollers engaging the marginal regions of the roof sections which are formed thereat with complementary channels for the rollers. A suitable drive arrangement is provided for energizing the panel system to run either to engage or disengage the said marginal regions of the roof sections. The drive arrangement may be of a similar kind as that of the deployment mechanism hereinbefore described.

According to a further aspect of the present invention, there is provided a deployment mechanism for a retractable roof system comprising in combination a system of ropes and pulleys and an actuating element adapted to effect anchoring of the or each roof section in its respective position, the actuating element being fluid operable and comprising at least one cylinder in which there is slidably disposed a weight in the form of a piston on which a fluid is operable. Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

Figure 1:
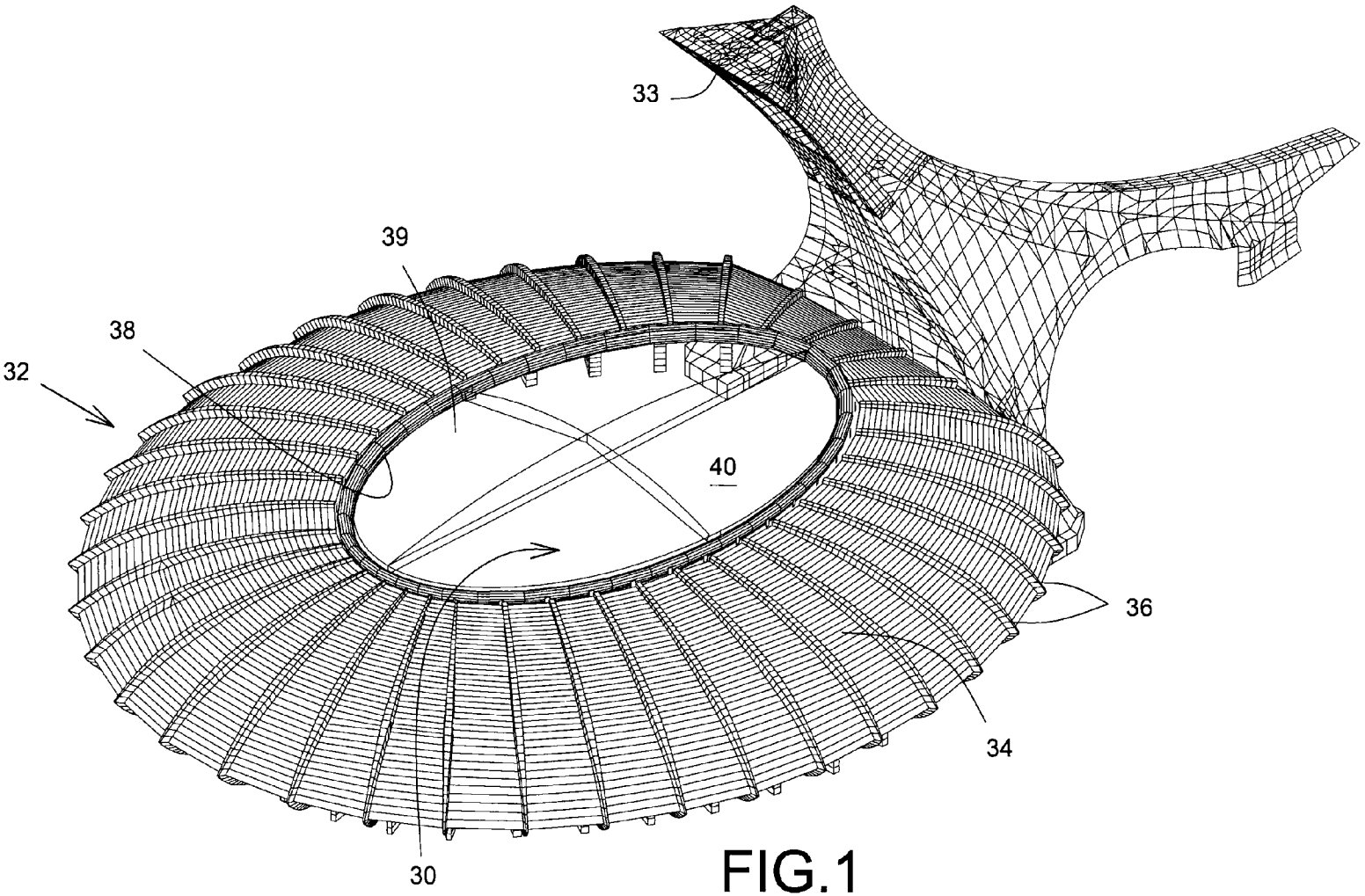
FIG. 1 is a top perspective view of a typical large building structure with a retractable roof system in accordance with an embodiment of the present invention.
Figure 2:
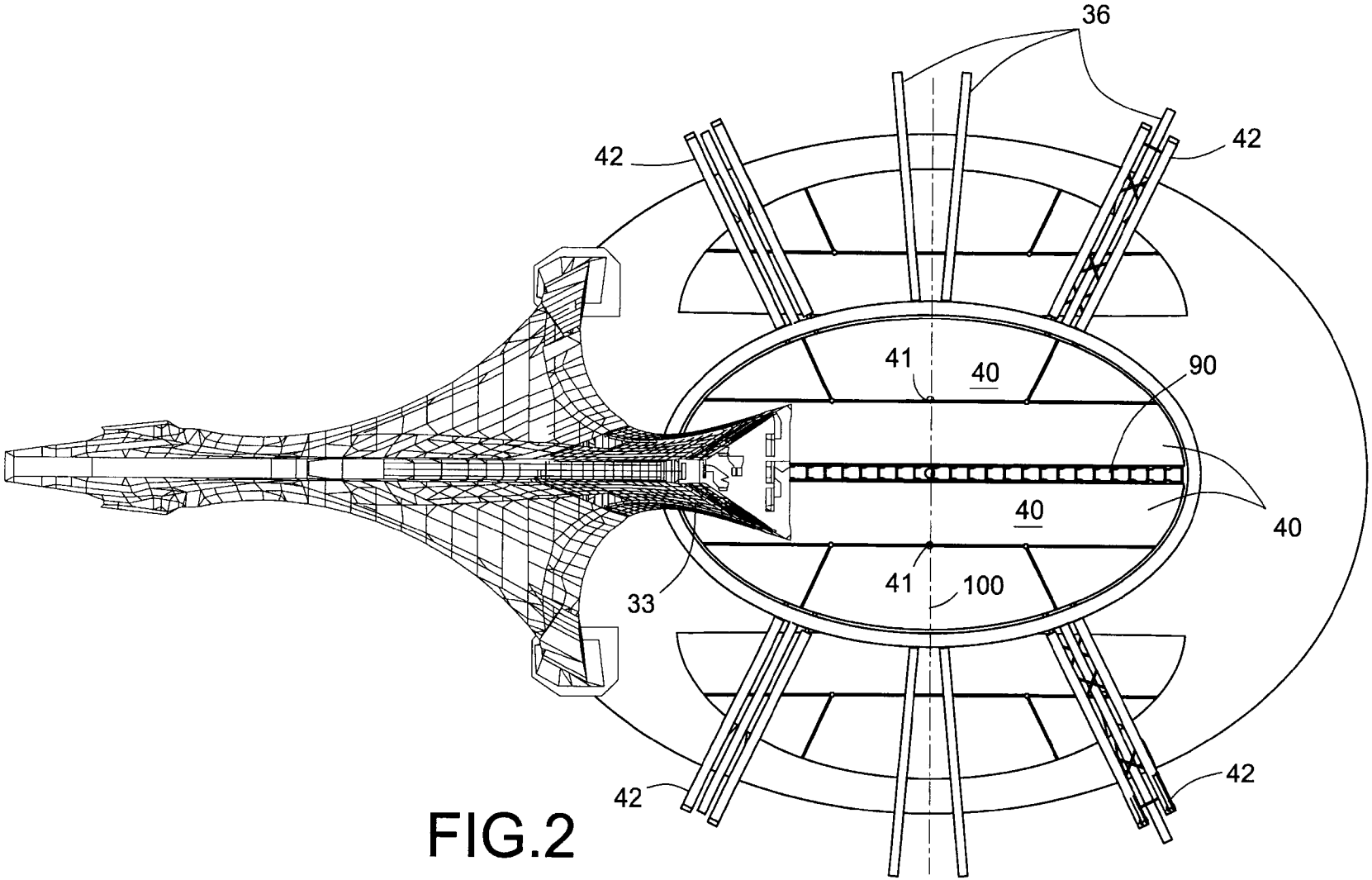
FIGS. 2 to 4 are partially broken top plan, side elevational, and rear elevational views of the embodiment of FIG. 1, with the roof section in closed position.

With reference to the annexed drawings, in most of which many parts have voluntarily been omitted for clarity purposes (especially when the intermediate support structure is shown across the opening while the roof sections are retracted, which is not an actual configuration), the preferred embodiments of the present invention will be herein described for indicative purpose and by no means as of limitation.

Referring to FIGS. 1 to 4, there is schematically shown an embodiment 30 of a retractable roof system for large building structures such as stadiums 32 and the like in accordance with the present invention, as well as the different innovative components of the system. Although some components may more specifically be usable with the presence of predetermined portions of the structure, some others are applicable to most structures. As illustrated throughout the Figures, the present invention is illustrated on a large building structure being the Olympic Stadium™ 32 of Montreal, Canada known for having an inclined tower 33 for the support of an original retractable cover membrane (not shown) using a plurality of wire cables (not shown).

The stadium 32 typically includes grandstand fixed roof 34 including a plurality of cantilevers 36 and running around the sport field 37 (see FIGS. 5 and 11) and defining an inner periphery 38 thereof itself defining a roof opening 39. Although not shown, the inner periphery could be defined by walls or even wall/roof structures. The retractable roof system 30 of the present invention includes at least one, preferably two roof sections 40 of a generally planar roof structure that substantially cover the opening 39. Each roof section 40 is supported by at least one, preferably two self-supporting generally monolithic piers 42. A typical embodiment of each pier 42 is connected to the roof section 40 via a roof connecting part in the form of a roof support bracket 44 movably mounted on the pier 42, for displacement of the support bracket 44, and the roof section 40, relative to the pier 42. A typical embodiment of a roof deployment mechanism 46 (better seen in FIG. 14) connected to the support bracket 44 activates the displacement of the roof section 40 between a closed or deployed position in which the roof section 40 covers a respective portion of the opening 39, as shown in FIGS. 1 to 7, and an open or undeployed or retracted position in which the respective portion of the opening 39 is uncovered by the roof section 40, as shown in FIGS. 8 to 14. In the retracted position, each roof section 40 is preferably completely overlaid by a portion of the fixed roof 34 but could also be located above the fixed roof 34, or simply at least partially over an uncovered grandstand 45 (schematically shown in dotted lines in FIG. 8), or outside a stadium outer periphery without departing from the scope of the present invention. Although the present piers 42 are substantially structurally independent from the structure of the stadium, they could eventually be part of that structure if required or desired. The piers 42 typically support the respective roof section 40 along a roof support axis passing by the center of gravity 41 of the section, when in the closed position.

Each pier 42 is a structure that surrounds and embraces an existing cantilever 36 of the stadium 32 (without structurally connecting thereto), and includes a foot 43 with a generally vertical column section 48 upstanding therefrom and supporting a generally horizontal top beam section 50 along which the respective support bracket 44 is displaced via rollers 52 engaging a sloping guide channel 54 expending along the beam section 50. As better seen in FIG. 7, the guide channel 54 slopes downwardly toward the column section 48 such that the support bracket 44 is maintained in the top end 56 of the guide channel 54 to have the roof section 40 in the closed position. To open the roof section 40, the support bracket 44 is controllably released from the top end 56 of the guide channel 54 toward the bottom end 58 by gravitational force.

Figure 8:
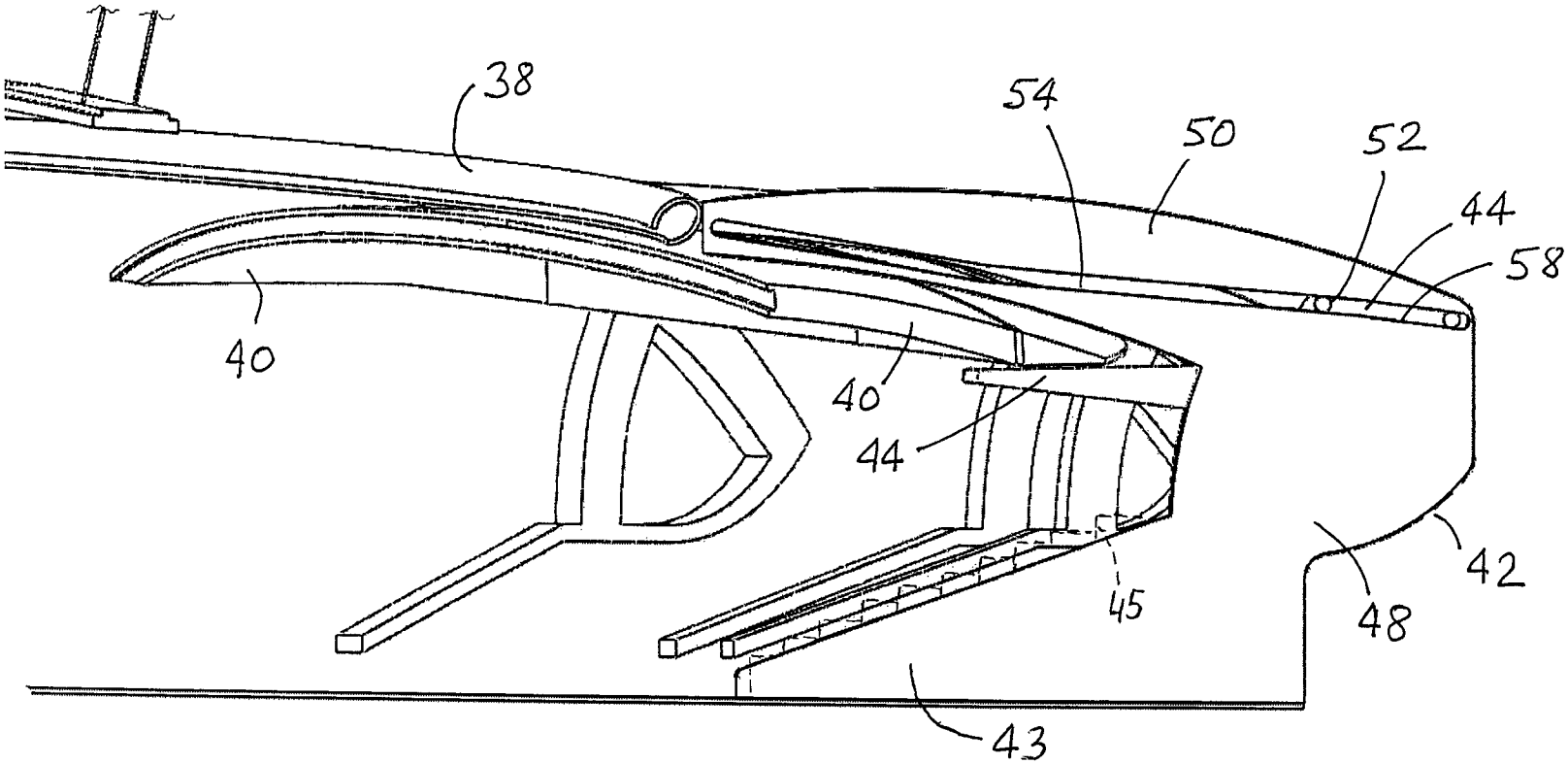
Figure 9:
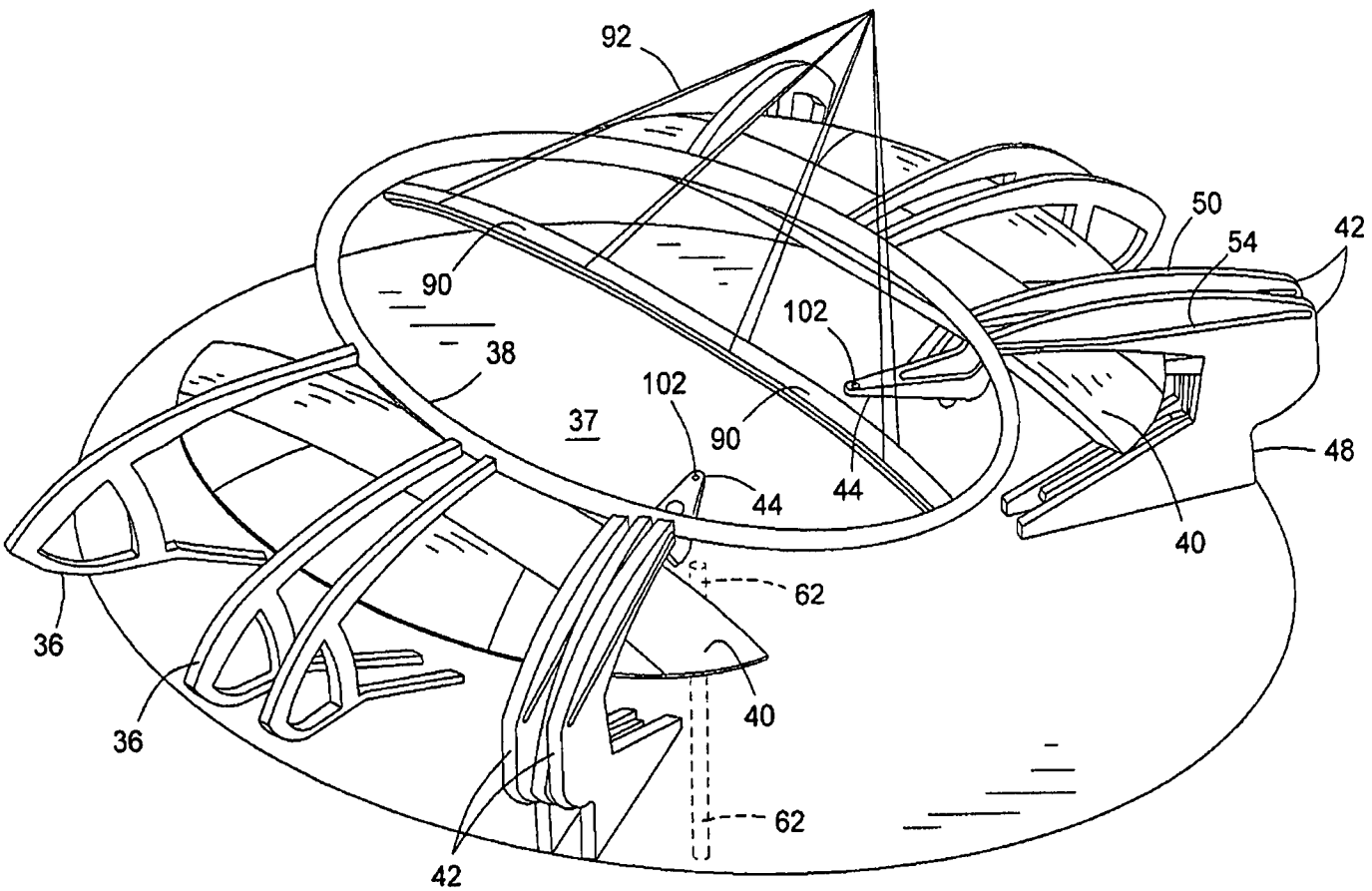
FIGS. 9 to 12 are different partially broken views of the embodiment of FIG. 1, with the roof section in retracted position.
Figure 10:
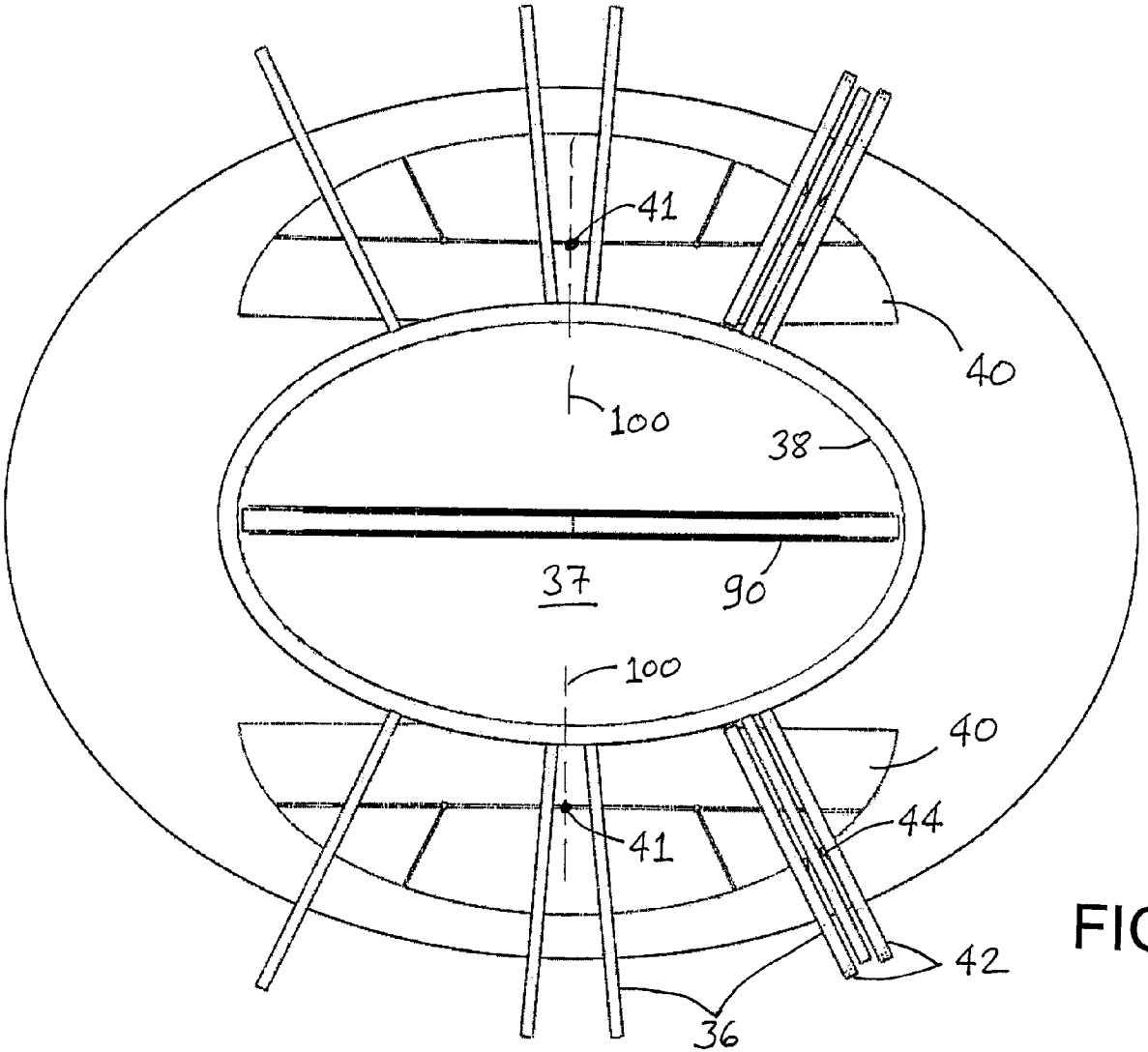
Figure 11:
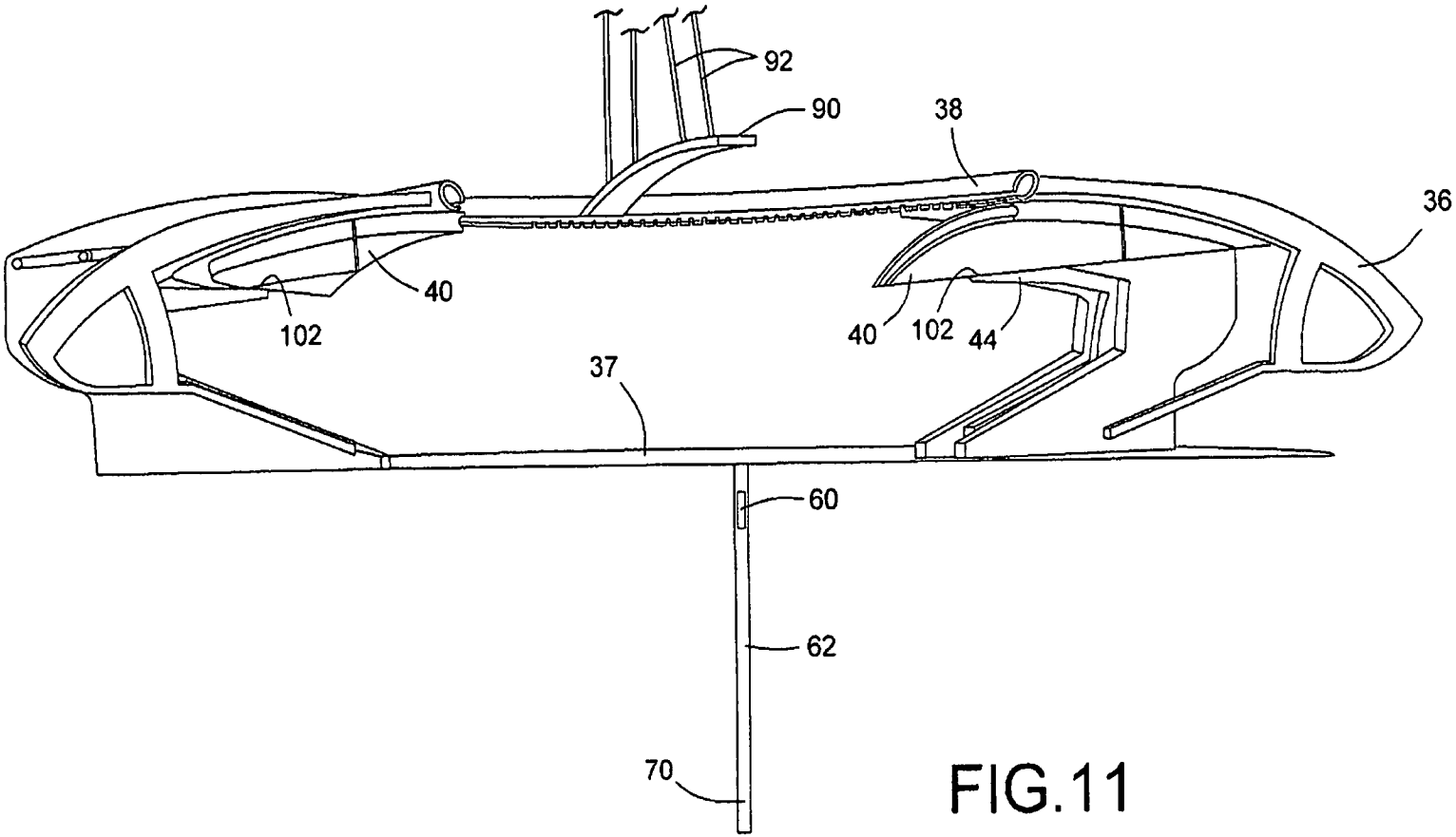
Figure 12:
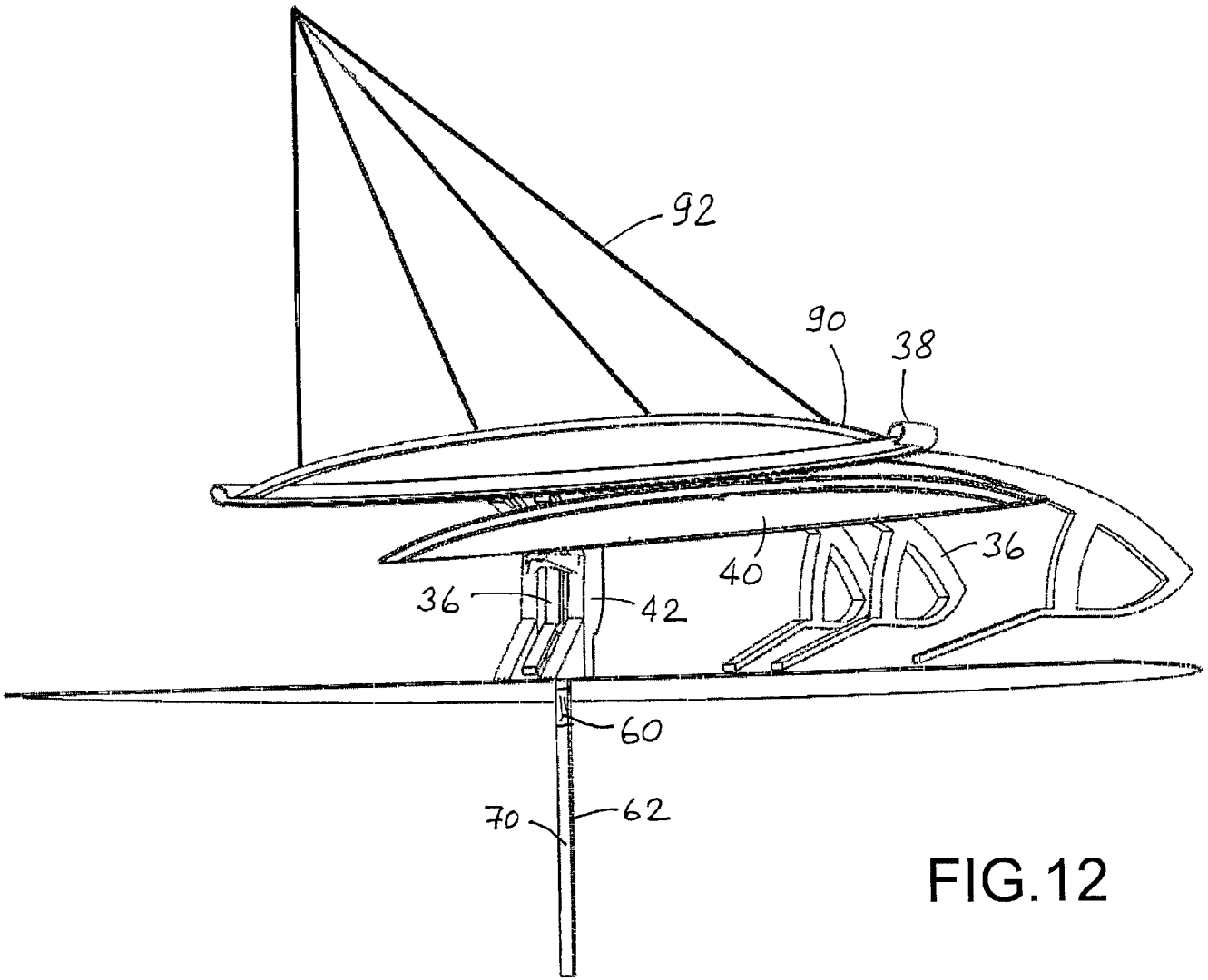
Figure 13:
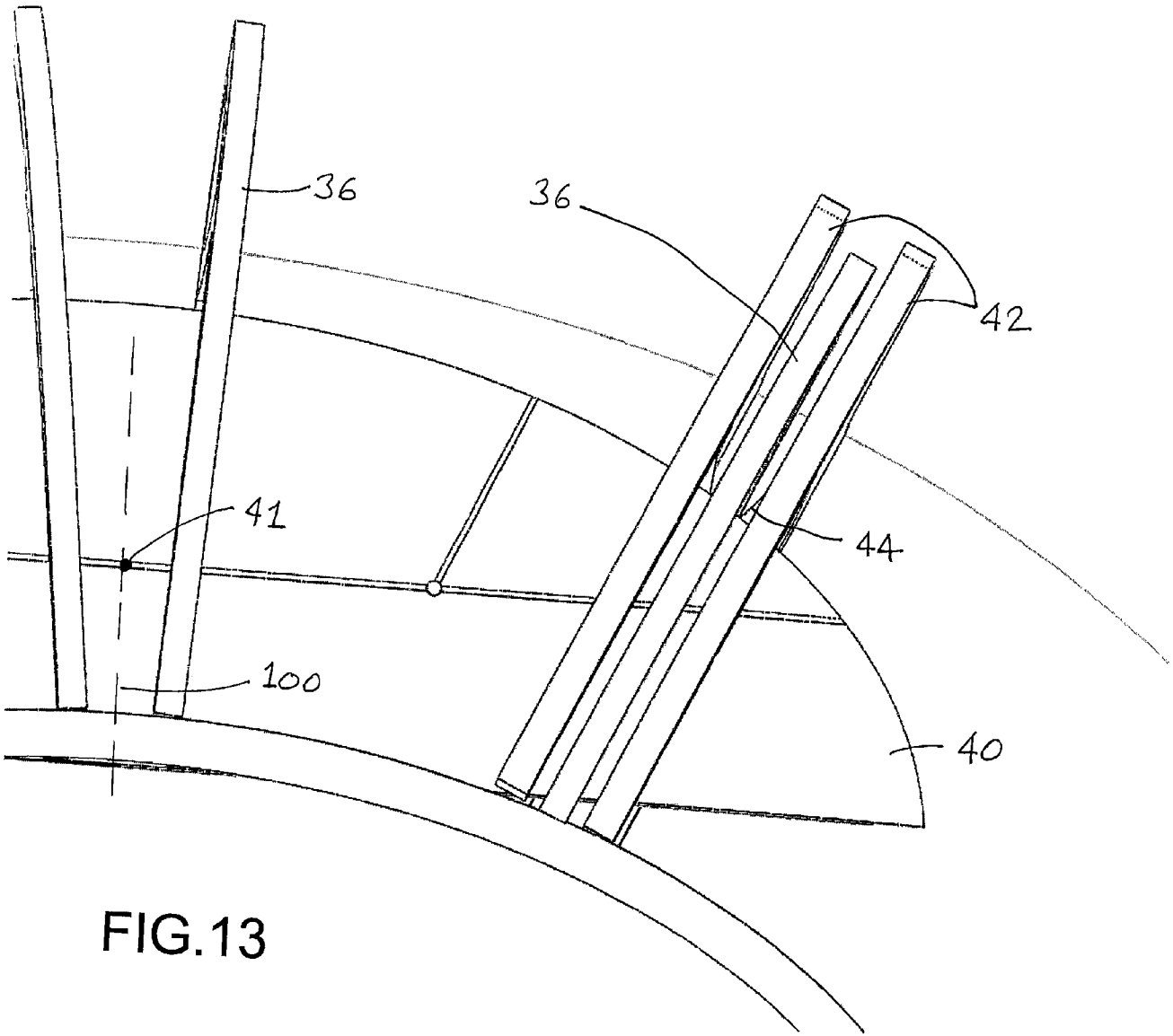
FIG. 13 is an enlarged partially broken top plan view of the embodiment of FIG. 1, with the roof section in retracted position.

Typically, the foot 43 of each pier 42 substantially tapers upwardly toward the intermediate vertical section 48 to generally follow a contour of the adjacent grandstand 45 of the building structure 32, as shown in FIG. 8.

Figure 14:
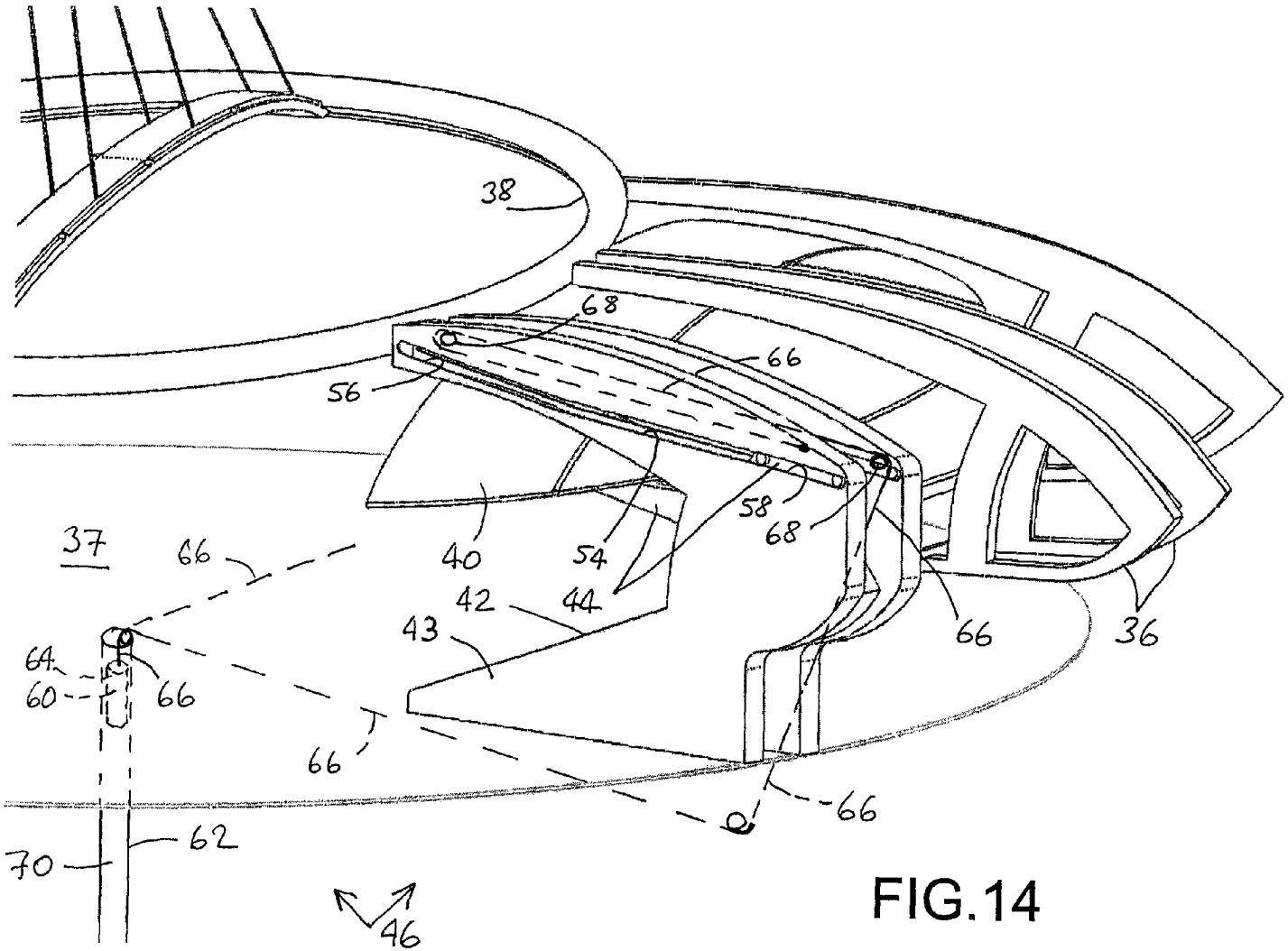
FIG. 14 is an enlarged partially broken top perspective view of the embodiment of FIG. 1, with the roof section in retracted position, and showing a portion of the roof deployment mechanism.
Figure 15D:
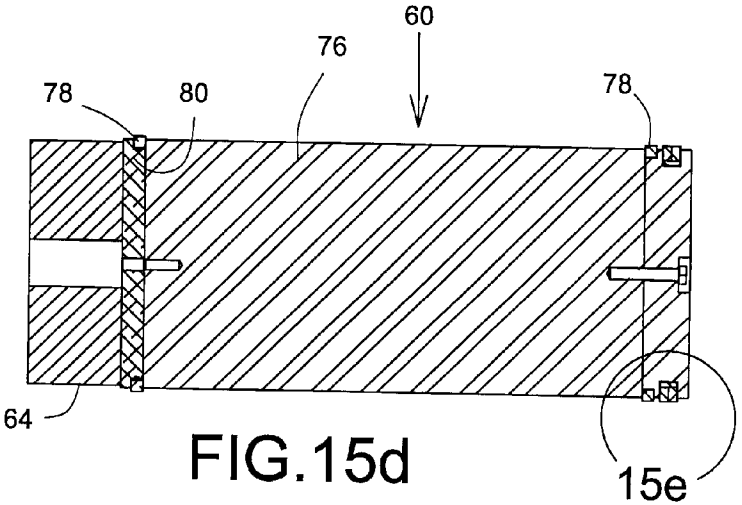
FIG. 15*d* is a longitudinal sectional view on the line 15*d*-15*d* of FIG. 15*b;*
Figure 15E:
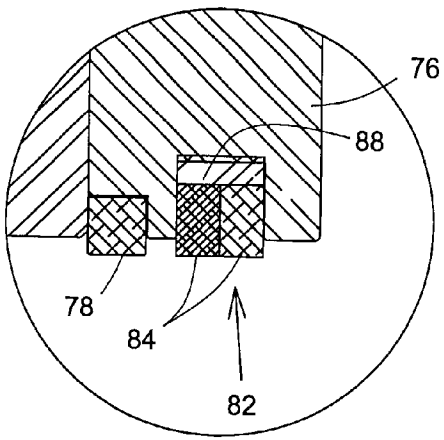
FIG. 15*e* is an enlarged fragmentary detailed view taken along line 15*e* of FIG. 15*d;*
Figure 15B:
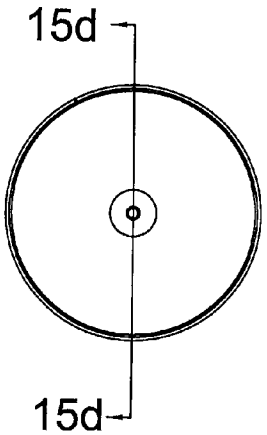
FIG. 15*b* is a top plan view of the piston of FIG. 15*a;*
Figure 15C:
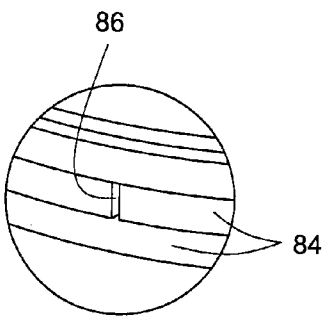
FIG. 15*c* is an enlarged fragmentary view taken along line 15*c* of FIG. 15*a;*
Figure 15A:
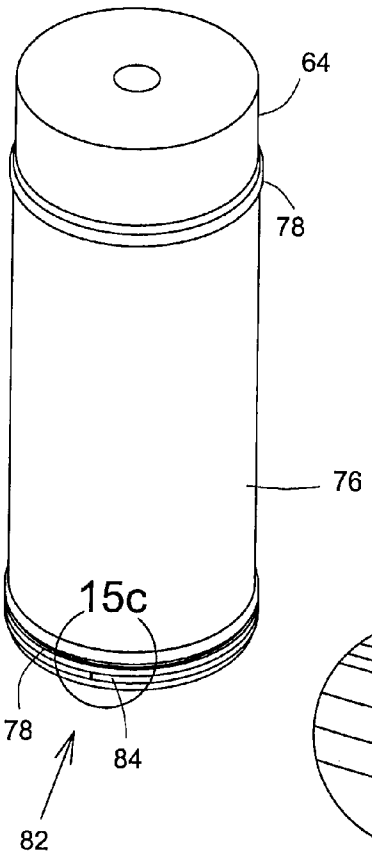
Figure 16:
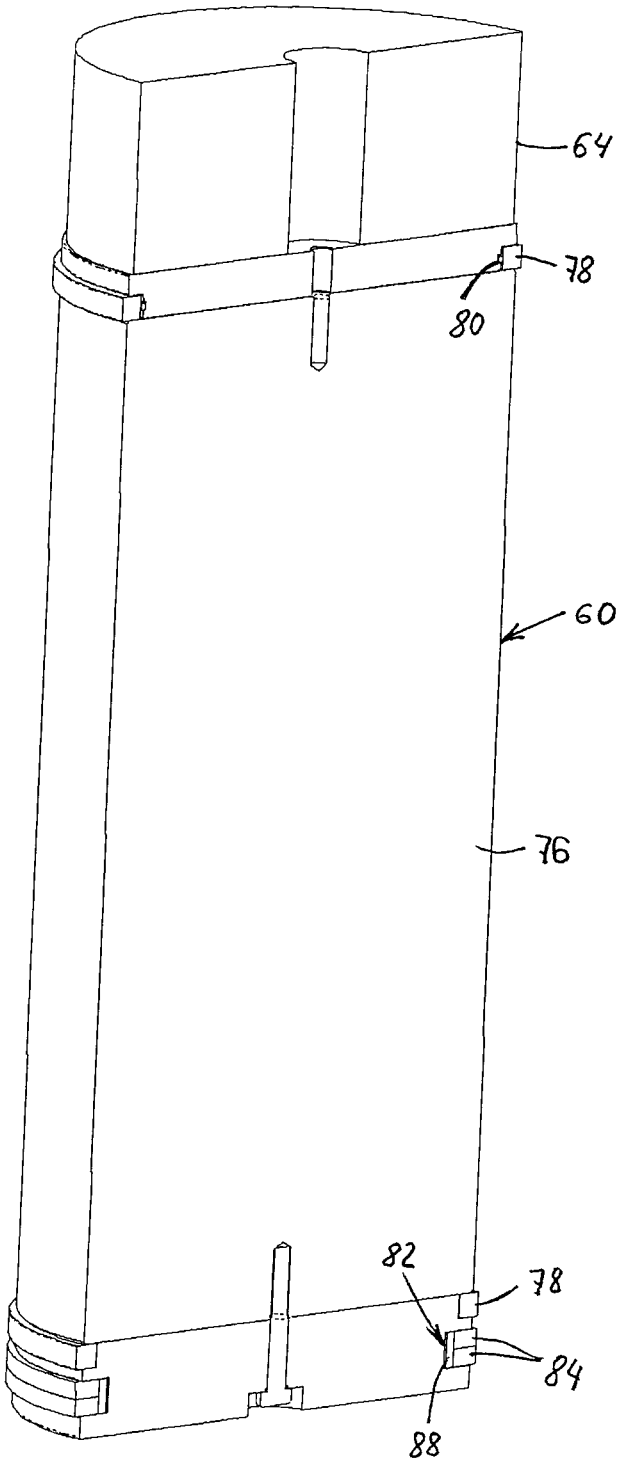
FIG. 16 is a perspective view of the embodiment of FIG. 15*a* sectioned on the line 15*d*-15*d* of FIG. 15*b;*

As better seen in FIG. 14, each support bracket 44 is connected to a deployment mechanism 46 typically including a weight 60 in the form of a piston slidably and sealably moving along a generally vertical hollow cylinder 62 preferably located underground. The upper end 64 of the weight 60 is connected to preferably all of the support brackets 44 respectively via the agency of a plurality of wire cables 66 or ropes and associated pulleys 68. The weight 60 has a sufficient mass to simultaneously maintain all the roof sections 40 in the closed position, with the respective support bracket 44 in the top end 56 of the guide channel 54. To controllably release the support brackets 44 and open the roof section 40, a pressurized gas is controllably injected into a closed volume of the cylinder 62 below the weight 60 and defining a pressurized chamber 70, using an appropriate valve system 72 to in effect push on and controllably raise the weight 60. As long as the pressure is maintained within the cylinder 62 below the weight 60, the roof section 40 remains open. To close the roof section 40 back, the pressure is slowly released from the pressurized chamber 70.

Although shown centrally located relative to the four piers 42 and their support brackets 44, the cylinder 62 can obviously be located anywhere. One skilled in the art would readily understand that although one corresponding cylinder/piston weight assembly could be used for each support bracket or for all support brackets of each roof section without departing from the scope of the present invention, it is preferable to simultaneously control all support brackets and roof sections on a common system.

The actual shape of the guide channel 54 is dictated by the shape of the roof section 40. The higher the slope of the top surface of the roof section 40, the higher the slope of the guide channel 54 to allow the roof section 40 to clear the inner periphery 38 of the fixed roof 34.

In order to allow the peripheral edges roof sections 40 to be essentially in register with the inner periphery 38 of the fixed roof 34, the roof sections 40 need to be generally vertically lowered before the actual opening may start. To this effect, as better seen in FIGS. 7 and 17, a pneumatic, hydraulic, electric, or the like deployed raising mechanism 74 is located between each support bracket 44 and the roof section 40. When a roof section 40 is supported by a plurality of brackets 44/piers 42, all the deployed raising mechanisms 74 of a same roof section 40 are obviously synchronized.

When the roof sections 40 are in the closed position, they remain slightly spaced from the fixed roof 34, and the gap there between would typically be covered by an outwardly extendable gutter (not shown) mounted onto the fixed roof 34, in order to completely close off the roof opening 39.

Weight Assembly

As, shown in FIGS. 15*a* to 15*e* and 16, the typical embodiment of a weight assembly in the form of a piston 60 typically has an elongated cylindrical body 76 having top and bottom ring-type cylinder bumpers 78, typically made out of wear resistant type plastic type material to ensure smooth axial displacement thereof along and inside the cylinder 62. The cylinder bumpers 78 are typically tight fit with the cylinder 62, and to this end, at least the upper bumper 78, which is longitudinally opposite the seal assembly 82, is radially outwardly biased to abut against the cylinder using a typical O-ring 80 or the like. On the other hand, to ensure a proper seal between the weight 60 and the cylinder 62 without jeopardizing the relative movement there between, the weight 60 includes a seal assembly 82, preferably located adjacent the bottom end thereof. The seal assembly 82 includes two side-by-side seal rings 84, typically made out of a polyimide type material or the like, preferably having their ring slots 86 angularly spaced from one another, typically at least 90 degrees, and preferably 180 degrees. Furthermore, the two seal rings 84 are typically biased radially outwardly towards the cylinder 62 by a compressed inner seal ring 88, typically made out of a rubber type material or the like. The inner seal ring 88 typically fills in the entire space between the two seal rings 84 and the piston body 76.

Intermediate Support Structure

Figure 3:
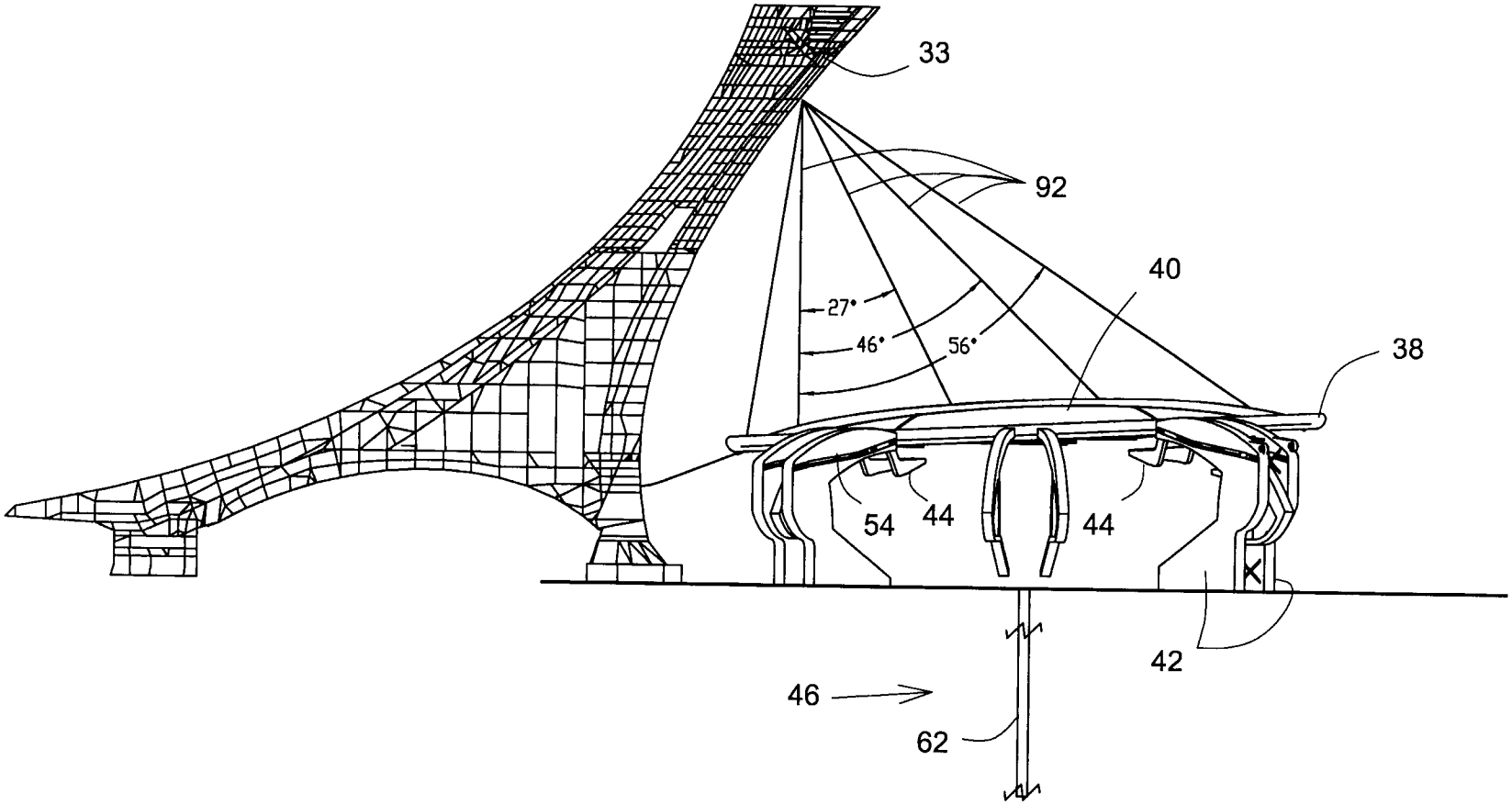
Figure 4:
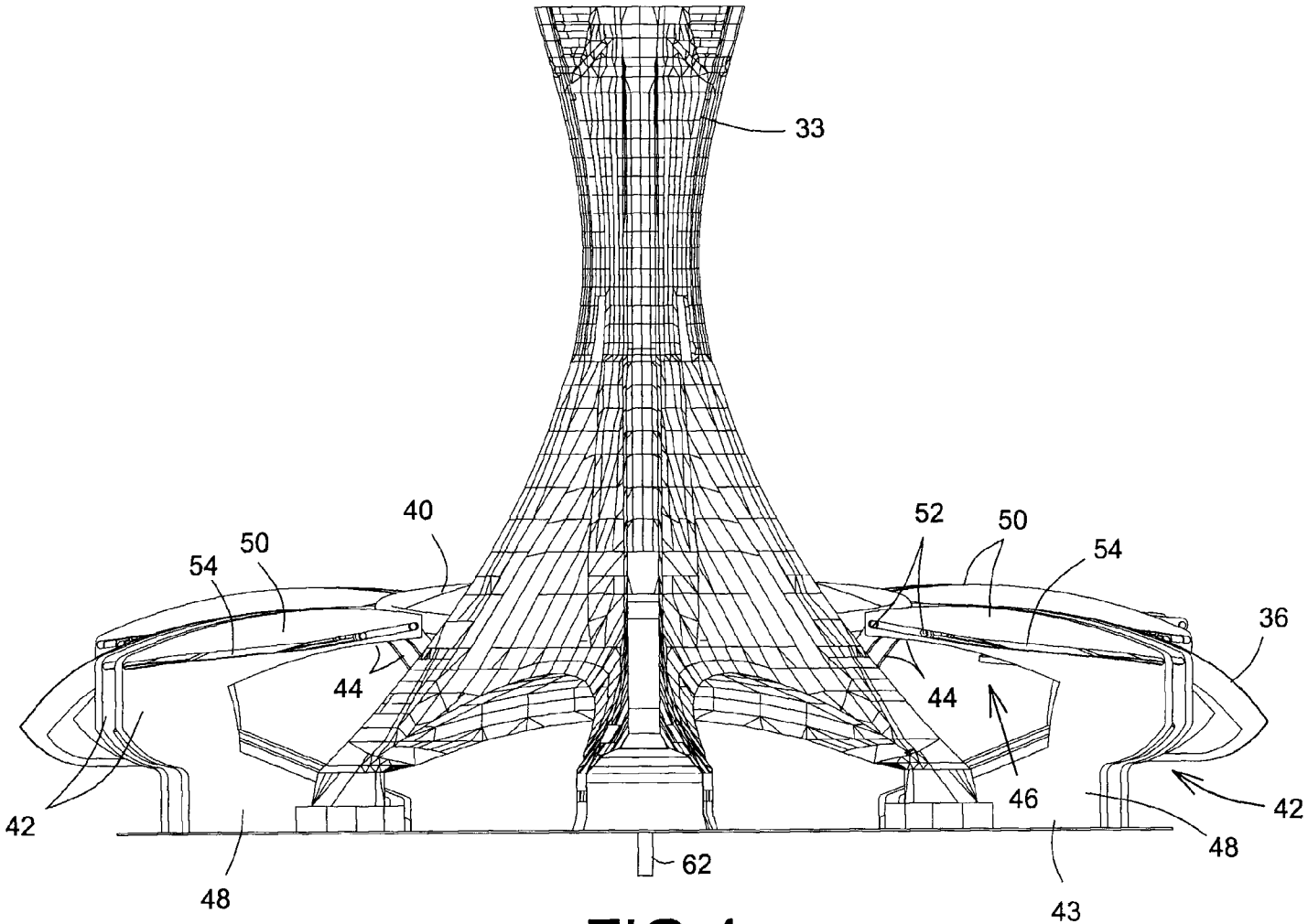
Figure 5:
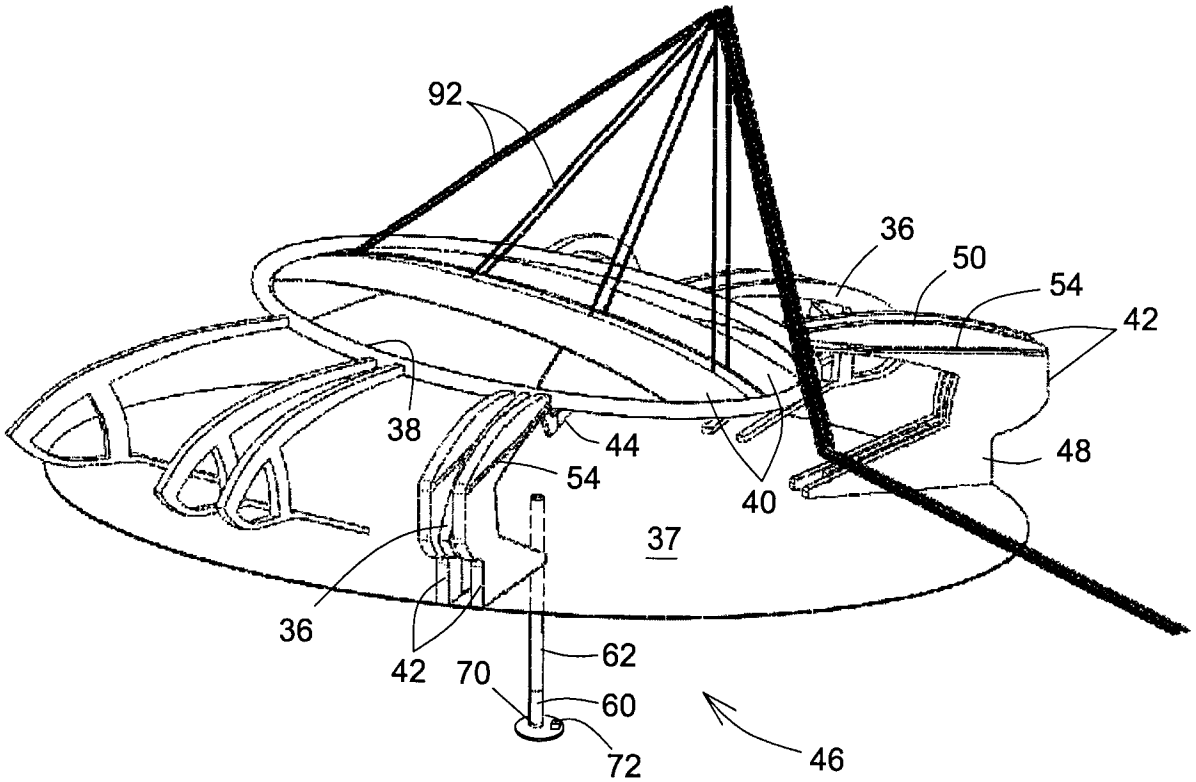
FIG. 5 is a partially broken top perspective view of the embodiment of FIG. 1, with the roof section in closed position.
Figure 6:
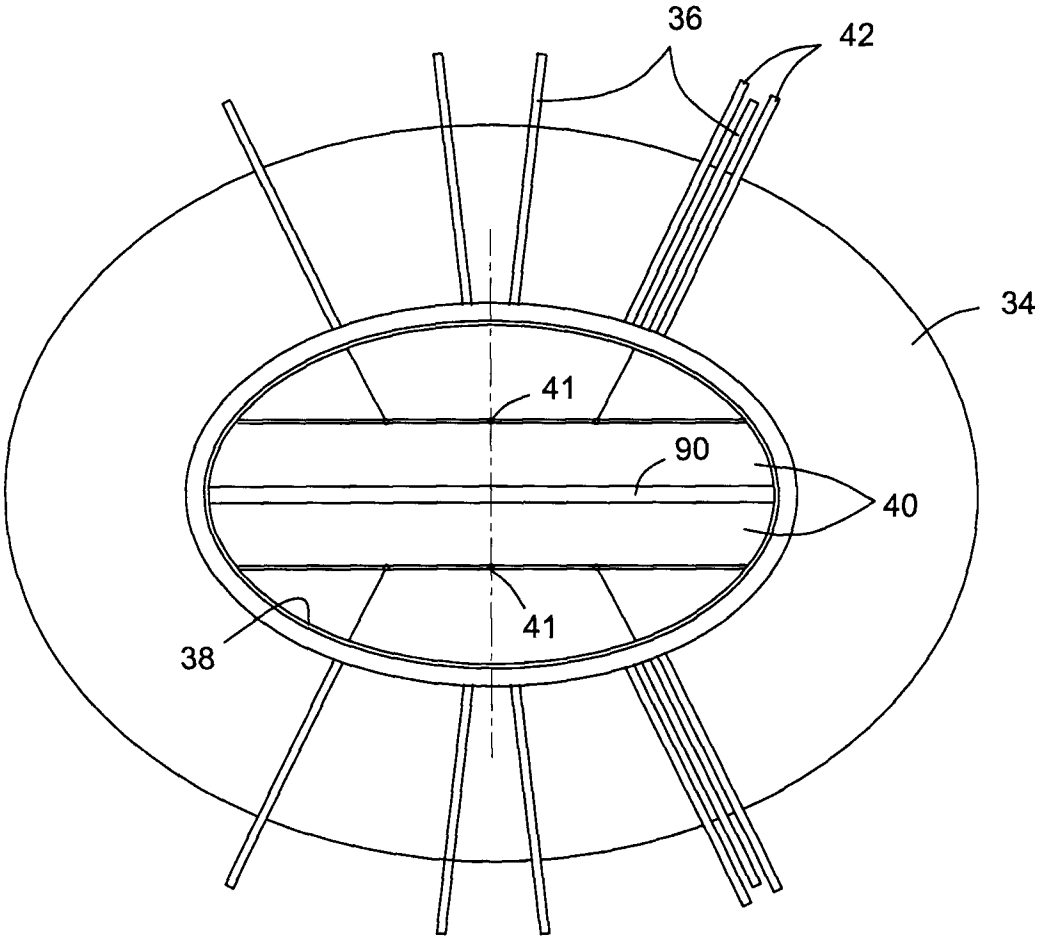
FIG. 6 is a partially broken top plan view of the embodiment of FIG. 1, with the roof section in closed position.
Figure 7:
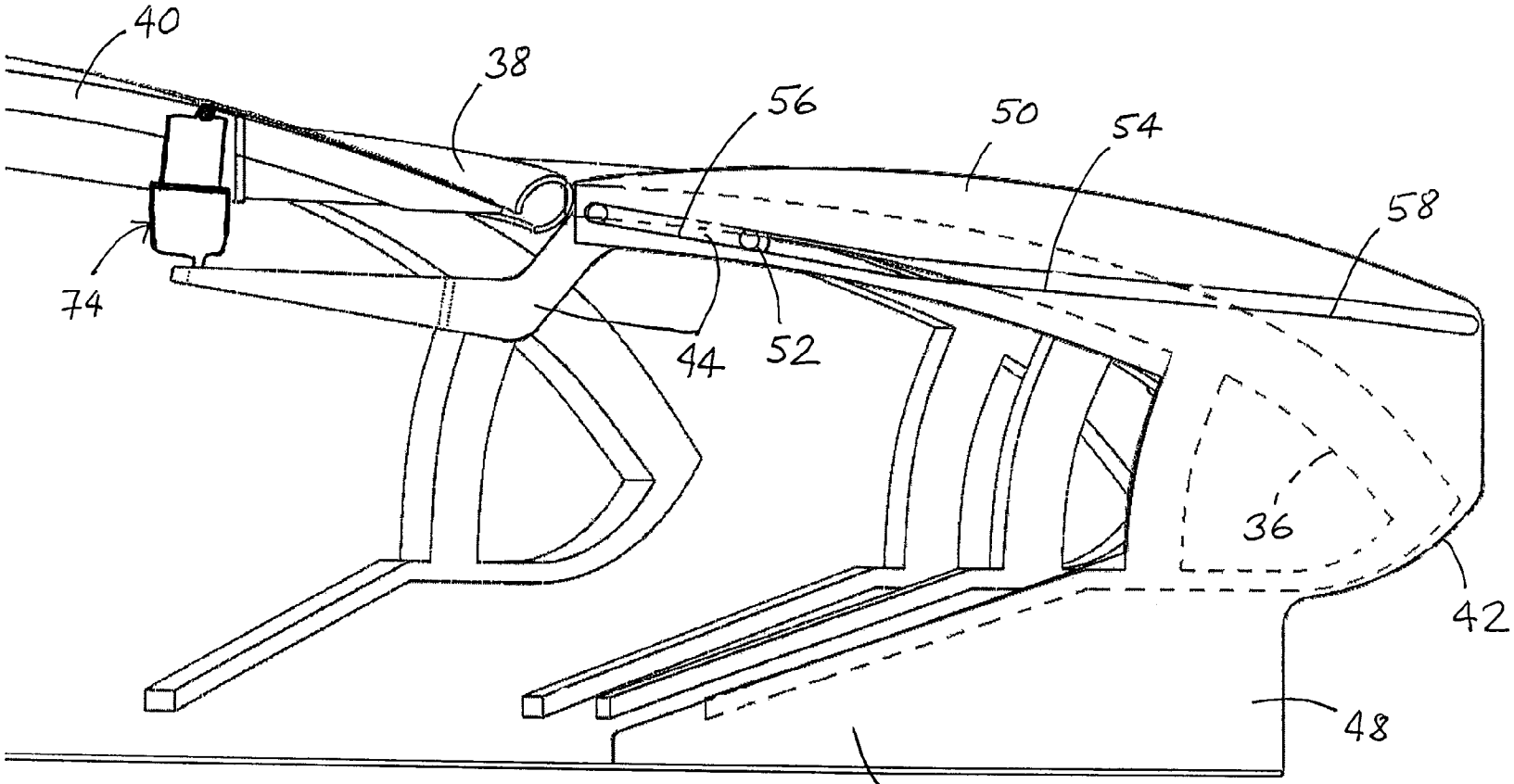
FIGS. 7 and 8 are partially broken section views of the embodiment of FIG. 1, with the roof section in closed and retracted positions, respectively.
Figure 17:
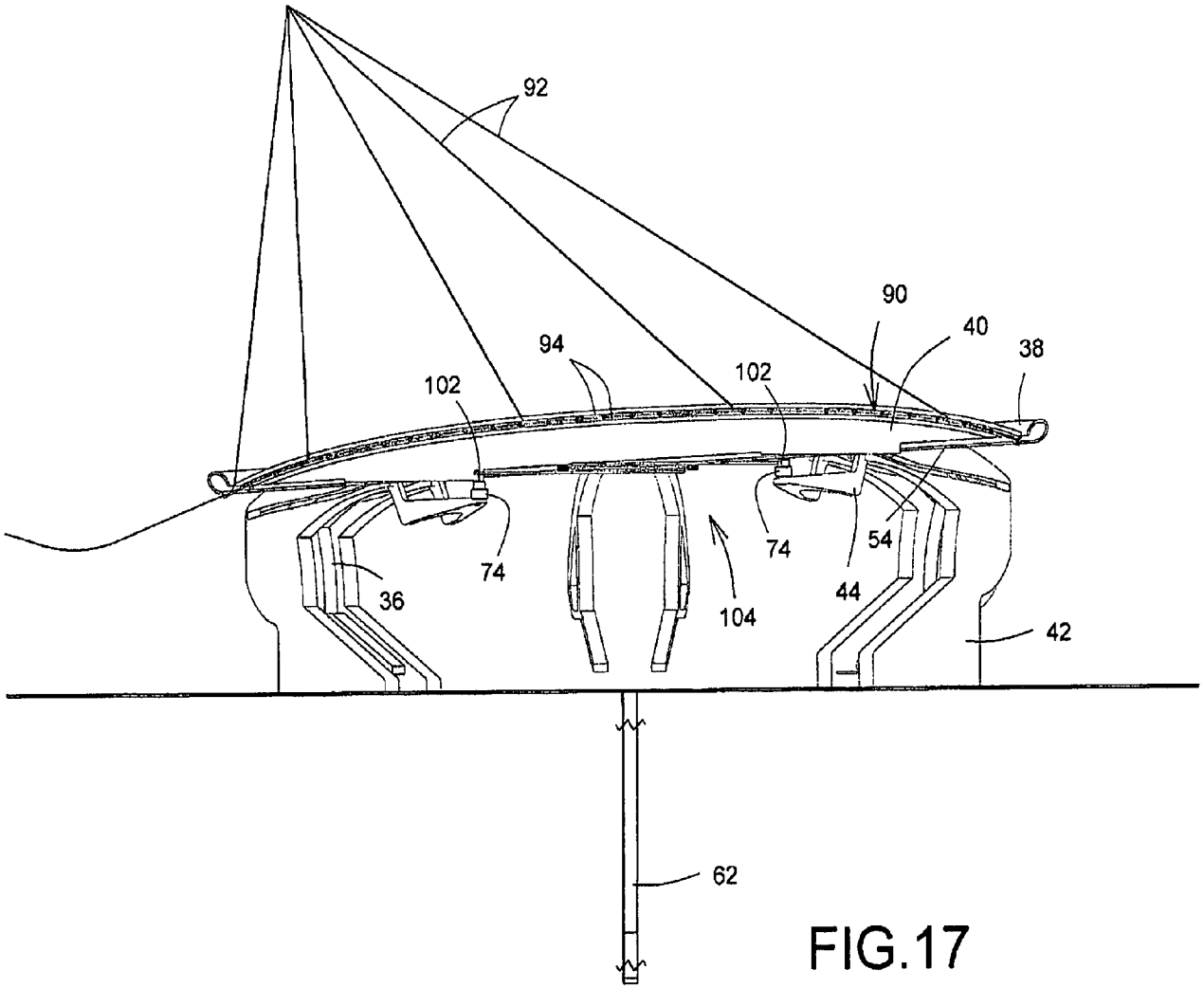
FIGS. 17 to 19 are different partially broken views of the embodiment of FIG. 1 of the intermediate support structure connecting the roof sections in closed position.
Figure 18:
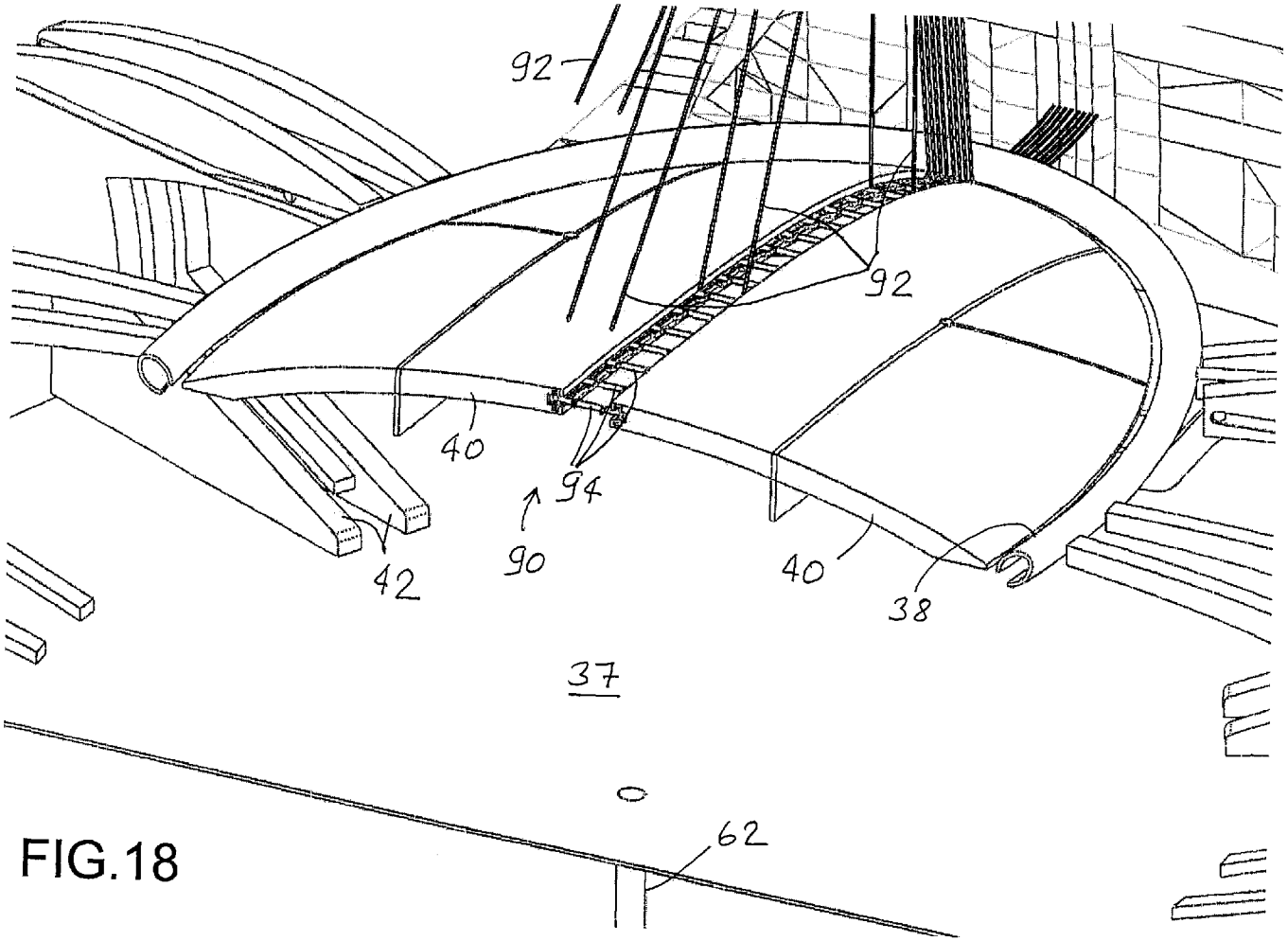
Figure 19:
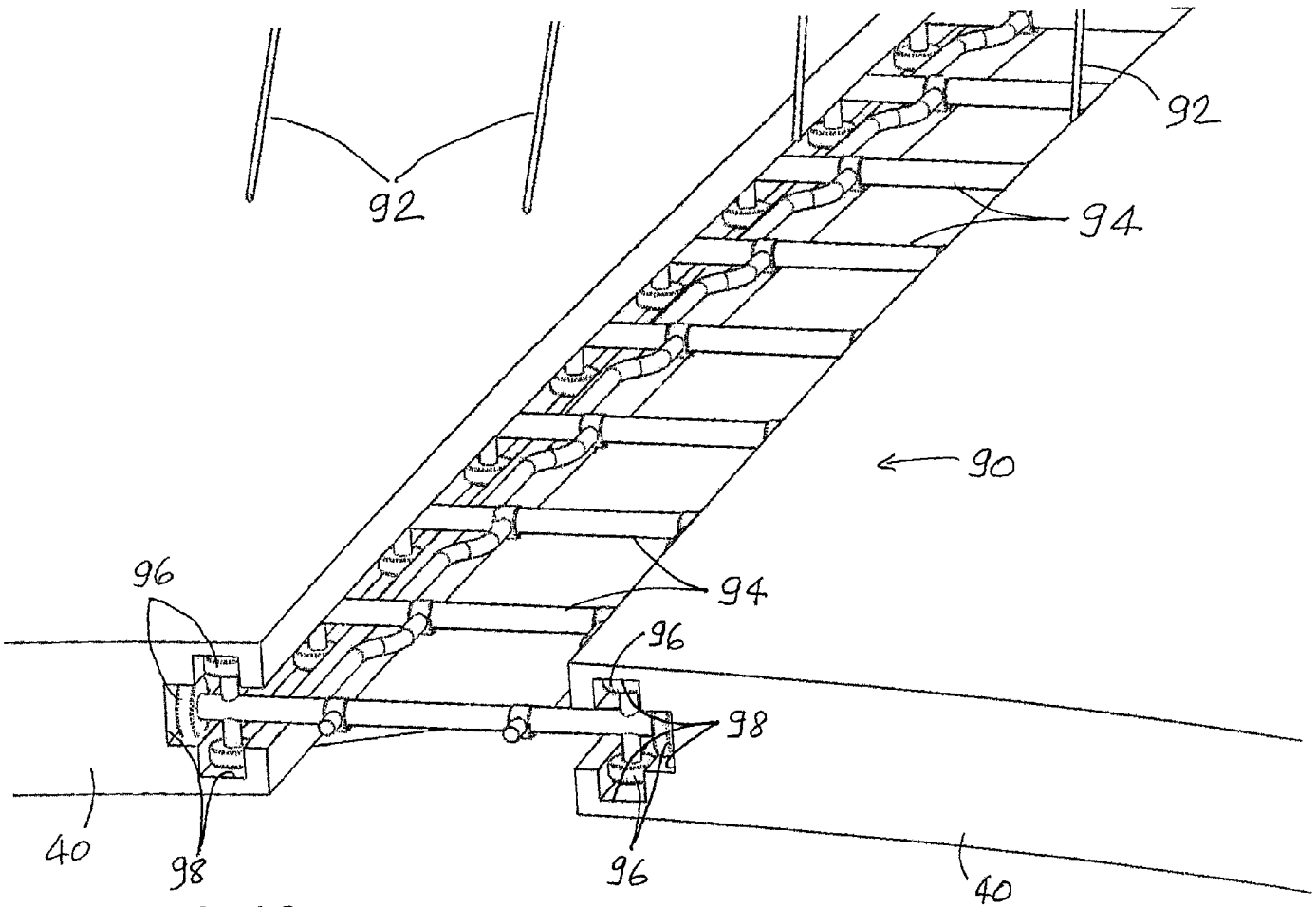
Figure 20:
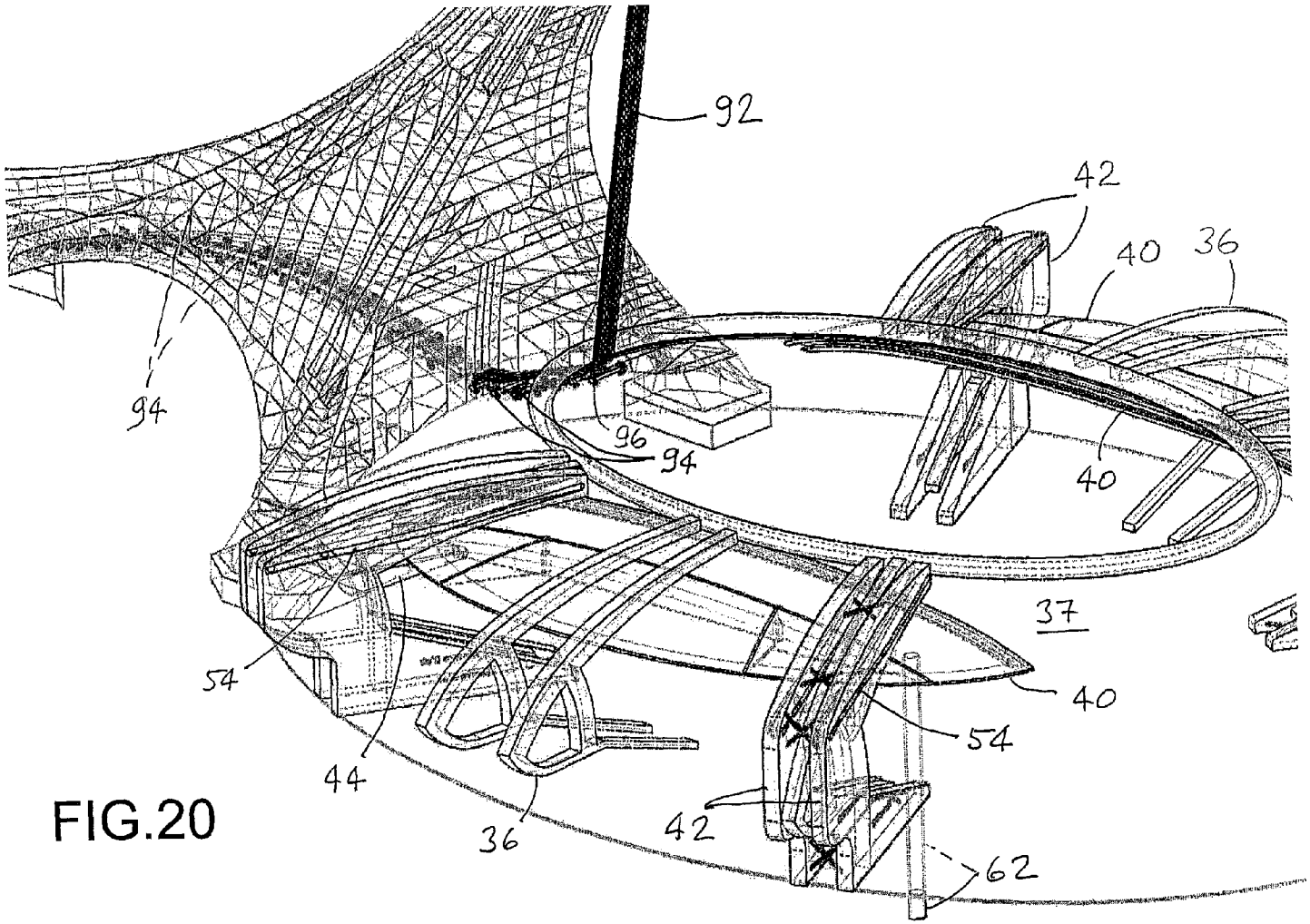
FIG. 20 is a partially broken top perspective view of the embodiment of FIG. 1 of the intermediate support structure displaced away from the roof opening, with the roof section in retracted position.

As better seen in a section view taken along a vertical plane passing in between the two roof sections 40, as in FIGS. 17, 18 and 19, an embodiment of removable intermediate support structure 90 includes a longitudinally articulated structure releasably connecting to both roof sections 40 (when in closed position) and supported by angled wire cables 92 running adjacent to a top end of the stadium tower 33. The intermediate support structure 90, adapted to close off a longitudinal gap between the two roof sections 40 when in closed position, typically includes a plurality of wheeled panels 94 (only frame structure shown in FIGS. 17 to 20) hingeably connected to the adjacent wheeled panels 94 into an end-to-end configuration (as cars in a train), and having side wheels 96 rollably engaging respective guide channels 98 extending along the roof sections 40. A plurality of wheeled panels 94, typically four, are each supported by a pair of wire cables 92, one connected adjacent each roof section 40 (as seen in FIGS. 3 and 17), the pairs of wire cables 92 are respectively angled at the vertical and successively at about 27, 46 and 56 degrees from the vertical). Each wire cable 92 of each pair has one end connected to the respective wheeled panel 94, passes around a first channeled wheel (not shown) freely rotatably mounted at the top of the tower 33 and the around successive channeled wheels (not shown) adjacent the opening periphery 38, and others, up to the other end connected to the tensioning mechanism (not shown) of any type and even another weight piston/cylinder assembly or the like. Although not illustrated, the two wire cables 92 of a same pair could be extending from one another as to form a single wire cable that would ensure a same tension on both sides of the respective wheeled panel 94 connected thereto.

Figures 21, 21A, 21B:
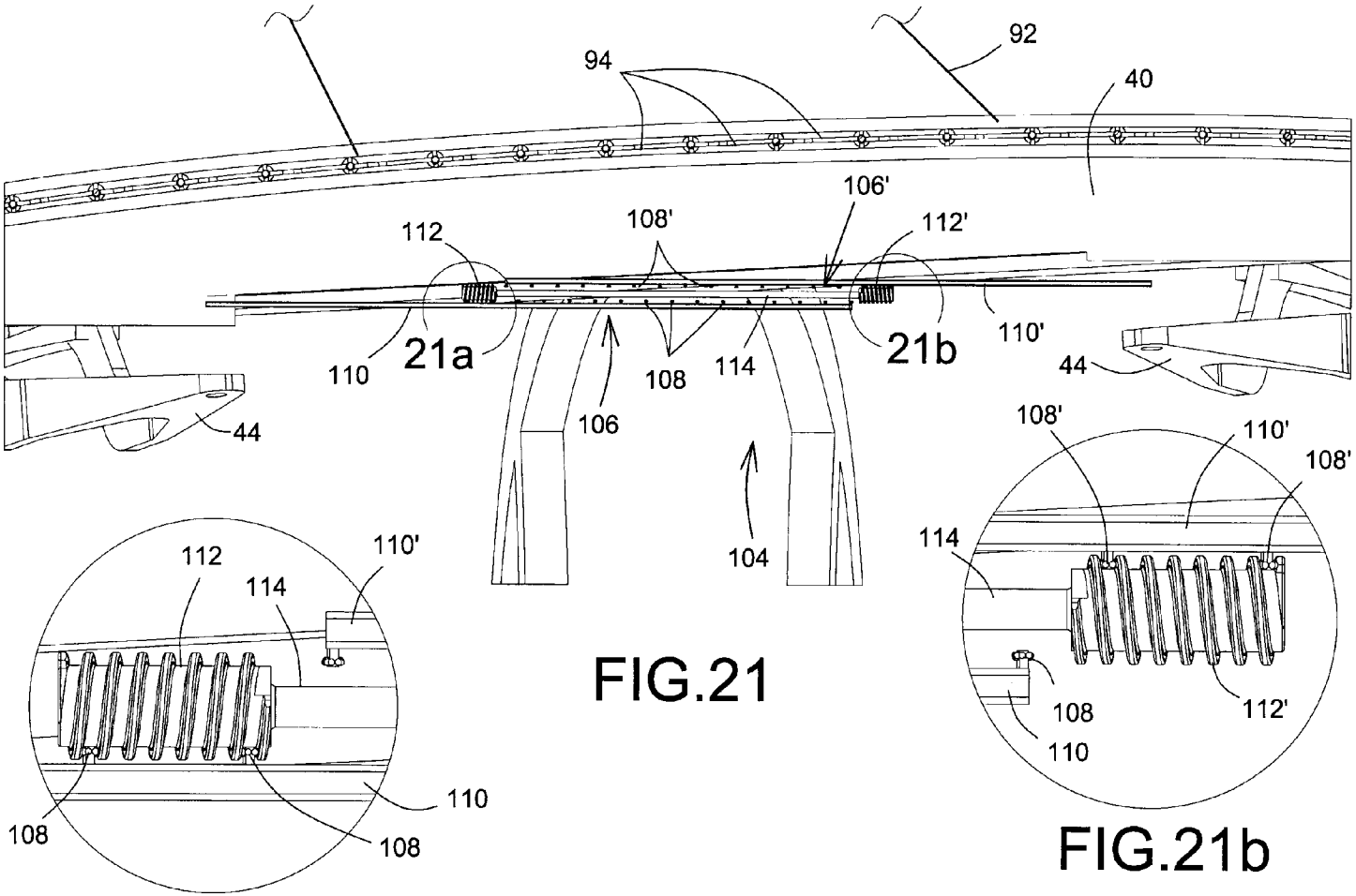
FIG. 21 is a partially broken side elevational view of the embodiment of FIG. 1, showing details of the synchronization mechanism, with the roof section in closed position.
FIGS. 21*a* and 21*b* are enlarged fragmentary detailed views taken along line 21*a* and line 21*b* of FIG. 21, respectively.

The intermediate support structure 90, such as a train panel structure, is adapted to be rollably displaced away from the two roof sections 40 into a storage channel (as illustrated in FIG. 21) to free up the two roof sections 40 and allowing them to be displaced into their retracted position. Here again, different type of driving mechanisms (not shown) could be considered, such as another weight piston/cylinder assembly or the like, depending on the needs.

Alternatively, the intermediate support structure 90 could be a more simple closing and releasably securing mechanism located between the two roof sections and mounted thereon (not shown).

Synchronization Mechanism

In the present case, as better seen in FIGS. 2, 6, 9, 10, 11, 13, and 17, since each pier 42 orientation is angled relative to the translation displacement direction 100 of the corresponding roof section 40 between the deployed and retracted positions, the angled displacement direction of each support bracket 44 forces the attachment point 102 of the respective support bracket 44 to the roof section 40 to translate relative to the center of gravity 41 of the roof section 40 perpendicularly to the translation displacement 100 of the roof section 40.

Figure 22:
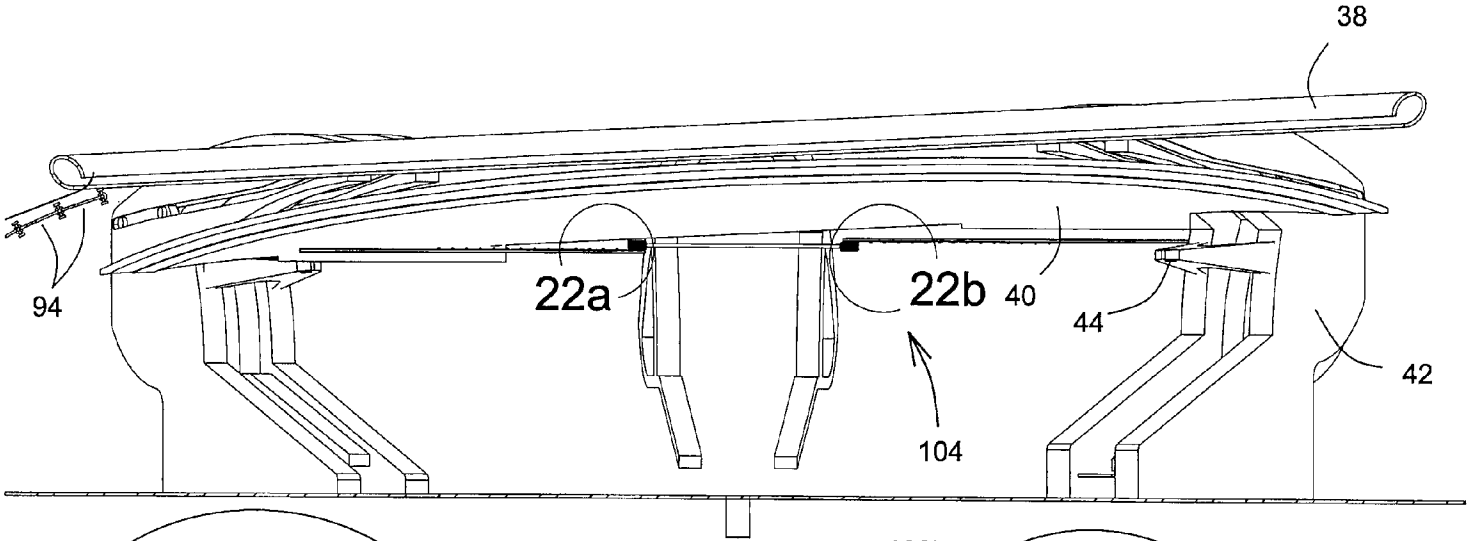
FIG. 22 is a partially broken side elevational view of the embodiment of FIG. 1, showing details of the synchronization mechanism, with the roof sections in retracted position.

Accordingly, to ensure that each roof section 40 does not get displaced sideways relative to its normal rectilinear translation displacement direction 100, since both piers 42 are similarly angled in opposite directions relative to the roof translation direction 100, a typical embodiment of a synchronization mechanism 104 ensures a simultaneous opposite longitudinal displacement of the two support brackets 44 relative to the roof section 40, as shown in FIGS. 21 and 22.

Figure 22B:
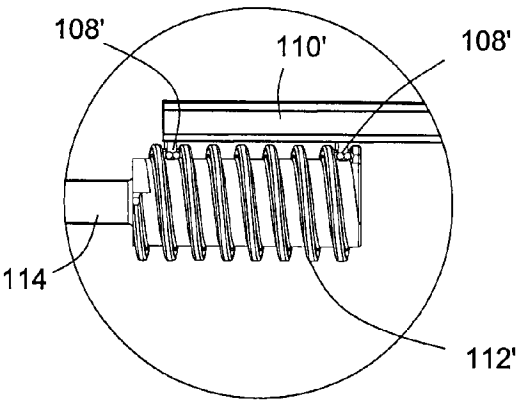
FIGS. 22*a* and 22*b* are enlarged fragmentary detailed views taken along line 22*a* and line 22*b* of FIG. 22, respectively.
Figure 22A:
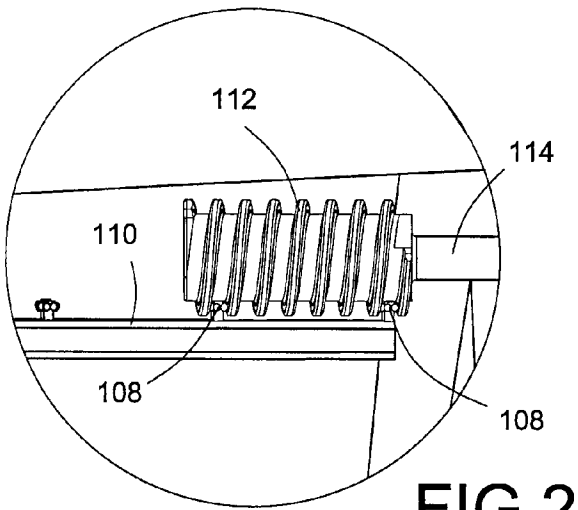

As shown in closed position in FIGS. 17, 21, 21*a* and 21*b* and in retracted position in FIGS. 22, 22*a* and 22*b*, the synchronization mechanism 104 includes a rack 106, 106' in the form of a plurality of successive bearing blocs 108, 108' mounted on a beam guide 110, 110' connecting to a respective support bracket 44 and meshing with a respective pinion screw 112, 112' in the form of a freely rotating screw mounted onto the roof section 40. To ensure the synchronization, both pinion screws 112, 112' are freely rotating about a common shaft 114, and to ensure the opposite displacements, the two pinion screws 112, 112' have opposite thread pitches (one 112 has a left thread, and the other 112' a right thread). The bearing blocks 108, 108' are adapted to engage both sides of a same thread to accommodate for displacements in both directions, for closing and retracting of the roof sections 40.

Although two roof sections 40 are described and shown herein, it would be obvious the each pier 42 could have supported its own roof section 40 that would have had substantially a quarter of the overall roof size, and similarly for any other number of roof sections and/or piers.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

The invention claimed is:

1. A retractable roof system (30) for a large building structure (32) for selectively closing off an opening (39) of a fixed roof (34) of the building structure (32), said retractable roof system (30) comprising:

a roof structure for covering the opening (39) and having at least one roof section (40);

at least one self-supporting structural pier (42) for supporting a corresponding said at least one roof section (40);

a deployment mechanism (46) having a roof connecting part (44) slidably mounting along a horizontal top section (50) of the corresponding said at least one pier (42) and connecting to a respective said at least one roof section (40), said deployment mechanism (46) allowing translational displacement of each said at least one roof section (40) along corresponding said at least one pier (42), while being supported thereby, between a deployed position in which said at least one roof section (40) closes off a corresponding portion of the opening (39), and a retracted position in which the corresponding portion of the opening (39) is uncovered with said at least one roof section (40) being generally located in vertical alignment with at least a portion of the fixed roof (34);

the deployment mechanism (46) further including a system of ropes (66) and pulleys (68) and an actuating element adapted to effect anchoring of said at least one roof section (40) in a respective position thereof, the actuating element being fluid operable and comprising at least one cylinder (62) in which there is slidably disposed a weight in the form of a piston (60) on which a fluid is operable;

wherein the piston (60) is of such dimension as to require a low-pressure fluid to effect requisite movement for said at least one roof section (40) to move, the application or removal of fluid pressure occasioning the necessary movement; and wherein the pulleys (68) are suitably arranged on the top section (50) of the at least one pier (42) at an inner end and an outer end thereof, and the ropes (66) extend from the piston (60) and are securely anchored to the roof connecting part (44) of the top section (50) of said at least one pier (42) whereupon in use movement of the ropes (66) causes translational movement of the roof connecting part (44).

2. A retractable roof system (30) according to claim 1 wherein said at least one cylinder (62) is vertically orientated.

3. A retractable roof system (30) according to claim 1 wherein the low-pressure fluid is compressed air and the supply is controlled by a valve (72).

4. A retractable roof system (30) according to claim 1 wherein the application of fluid pressure into the at least one cylinder (62) to raise the corresponding piston (60) causes the corresponding roof section (40) to be displaced from the retracted position towards the deployed position, and the removal of the fluid pressure from the at least one cylinder (62) causes the piston (60) to move downward and the corresponding roof section (40) to be displaced from the deployed position towards the retracted position.

5. A retractable roof system (30) according to claim 4 wherein supply of the low-pressure fluid is controlled by a valve (72).

6. A retractable roof system (30) according to claim 5 wherein the low-pressure fluid being supplied by the valve (72) into a pressurized chamber (70) of the at least one cylinder (62) defined below said corresponding piston (60) to raise the corresponding piston (60), the valve further allowing removal of the low-pressure fluid from the pressurized chamber (70) by said corresponding piston (60) under gravity causing the piston (60) to move downward.

* * * * *